US005944571A

United States Patent [19]

van Raalte et al.

[11] Patent Number: 5,944,571

[45] Date of Patent: Aug. 31, 1999

[54] METHOD OF MAKING COLOR PICTURE TUBES HAVING A MIX OF ELECTRON GUNS

[75] Inventors: John A van Raalte; Jean-Pierre Garnier; Olivier Pierre Trinchero, all of Dijon, France

[73] Assignee: Thomson Tubes and Displays, S.A., Boulogne Cedex, France

[21] Appl. No.: 08/908,167

[22] Filed: Aug. 7, 1997

[51] Int. Cl.[6] ..... F23Q 23/08

[52] U.S. Cl. ..... 445/3

[58] Field of Search ..... 445/3, 34, 36; 313/2.1

[56] References Cited

U.S. PATENT DOCUMENTS

| | | | |
|---|---|---|---|
| 4,881,006 | 11/1989 | Hedrick | 313/450 |
| 4,952,186 | 8/1990 | Maninger et al. | 445/36 |
| 5,010,271 | 4/1991 | Maninger et al. | 313/412 |
| 5,543,681 | 8/1996 | Jo | 313/414 |

FOREIGN PATENT DOCUMENTS

0251404A1 1/1988 European Pat. Off. ..... H01J 9/34

OTHER PUBLICATIONS

*French Search Report dated: Apr. 25, 1997.
PCT Search Report.

*Primary Examiner*—Sandra O'Shea
*Assistant Examiner*—Michael J. Smith
*Attorney, Agent, or Firm*—Joseph S. Tripoli; Dennis H. Irlbeck

[57] ABSTRACT

The present invention provides an improvement in a method of making a plurality of color picture tubes of approximately the same size and including a mix of at least two different types of electron guns therein. The electron guns include each a plurality of electrodes, with each electrode having openings for the passage of three electron beams. The improvement comprises selecting materials for each electrode of the at least two different types of electron guns that will produce a minimum difference in the focus voltage sensitivities between the two different types of electron guns.

4 Claims, 3 Drawing Sheets

TUBE A

| Electrode | Sens. coeff. | Std. Mat'l. | Exp. Coeff. 1.00E-6 per °C | Tube A gun expansion (μm) | Tube A gun expansion, but with... G2 430 (μm) | G1 305 (μm) | G3b 305 (μm) | G4 FN48 (μm) | G2 FN42 (μm) | G2 FN48 (μm) | G4 FN42 (μm) | G4 Invar (μm) |
|---|---|---|---|---|---|---|---|---|---|---|---|---|
| G1 | 43 | 430 | 11 | 40 | 40 | 69 | 40 | 40 | 40 | 40 | 40 | 40 |
| G2 | -67 | 305 | 19 | 38 | 22 | 38 | 38 | 38 | 9 | 20 | 38 | 38 |
| G3b | 24 | FN48 | 10 | 10 | 10 | 10 | 19 | 10 | 10 | 10 | 10 | 10 |
| G3t | 10 | FN48 | 10 | 10 | 10 | 10 | 10 | 10 | 10 | 10 | 10 | 10 |
| G4 | -21 | 305 | 19 | 18 | 18 | 18 | 18 | 9 | 18 | 18 | 4 | 1 |
| G5b | 9 | 305 | 19 | 16 | 16 | 16 | 16 | 16 | 16 | 16 | 16 | 16 |
| G5t | 4 | 305 | 19 | 14 | 14 | 14 | 14 | 14 | 14 | 14 | 14 | 14 |
| G6 | -3 | 305 | 19 | 12 | 12 | 12 | 12 | 12 | 12 | 12 | 12 | 12 |
| Nominal Frat-X (μm) | | | | -700 | 372 | 551 | -484 | -521 | 1243 | 506 | -412 | -352 |

TUBE B

| Electrode | Sens. coeff. | Std. Mat'l. | Exp. Coeff. 1.00E-6 per °C | Tube B gun expansion (μm) | Tube A gun expansion, but with... G2 430 (μm) | G1 305 (μm) | G3b 305 (μm) | G4 FN48 (μm) | G2 FN42 (μm) | G2 FN48 (μm) | G1 430 (μm) | G2 305 (μm) | G4 Invar (μm) |
|---|---|---|---|---|---|---|---|---|---|---|---|---|---|
| G1 | 15 | Invar | 3 | 12 | 12 | 69 | 12 | 12 | 12 | 12 | 40 | 12 | 12 |
| G2 | -35 | FN42 | 4.5 | 9.5 | 23 | 9.5 | 9.5 | 9.5 | 9 | 20 | 4 | 38 | 9.5 |
| G3b | 20 | FN48 | 10 | 10 | 10 | 10 | 19 | 10 | 10 | 10 | 10 | 10 | 10 |
| G3t | 8 | FN48 | 10 | 10 | 10 | 10 | 10 | 10 | 10 | 10 | 10 | 10 | 10 |
| G4 | -17 | FN42 | 4.5 | 4.5 | 4.5 | 4.5 | 4..5 | 9.5 | 4.5 | 4.5 | 4 | 4 | 1.5 |
| G5b | 8 | 305 | 19 | 16 | 16 | 16 | 106 | 16 | 16 | 16 | 16 | 16 | 16 |
| G5t | 5 | 305 | 19 | 14 | 14 | 14 | 14 | 14 | 14 | 14 | 14 | 14 | 14 |
| G6 | 2 | 305 | 19 | 12 | 12 | 12 | 12 | 12 | 12 | 12 | 12 | 12 | 12 |
| Nominal Frat-X (μm) | | | | 273 | -207 | 1128 | 453 | 188 | 291 | -95 | 894 | -716 | 324 |

TUBE A

| Electrode | Sens. coeff. | Std. Mat'l. | Exp. Coeff. 1.00E-6 per °C | Tube A gun expansion (μm) | Tube A gun expansion, but with... G2 430 (μm) | G1 305 (μm) | G3b 305 (μm) | G4 FN48 (μm) | G2 FN42 (μm) | G2 FN48 (μm) | G4 FN42 (μm) | G4 Invar (μm) |
|---|---|---|---|---|---|---|---|---|---|---|---|---|
| G1 | 43 | 430 | 11 | 40 | 40 | 69 | 40 | 40 | 40 | 40 | 40 | 40 |
| G2 | -67 | 305 | 19 | 38 | 22 | 38 | 38 | 38 | 9 | 20 | 38 | 38 |
| G3b | 24 | FN48 | 10 | 10 | 10 | 10 | 19 | 10 | 10 | 10 | 10 | 10 |
| G3t | 10 | FN48 | 10 | 10 | 10 | 10 | 10 | 10 | 10 | 10 | 10 | 10 |
| G4 | -21 | 305 | 19 | 18 | 18 | 18 | 18 | 9 | 18 | 18 | 4 | 1 |
| G5b | 9 | 305 | 19 | 16 | 16 | 16 | 16 | 16 | 16 | 16 | 16 | 16 |
| G5t | 4 | 305 | 19 | 14 | 14 | 14 | 14 | 14 | 14 | 14 | 14 | 14 |
| G6 | -3 | 305 | 19 | 12 | 12 | 12 | 12 | 12 | 12 | 12 | 12 | 12 |
| Nominal Frat-X | (μm) | | | -700 | 372 | 551 | -484 | -521 | 1243 | 506 | -412 | -352 |

TUBE B

| Electrode | Sens. coeff. | Std. Mat'l. | Exp. Coeff. 1.00E-6 per °C | Tube B gun expansion (μm) | Tube A gun expansion, but with... G2 430 (μm) | G1 305 (μm) | G3b 305 (μm) | G4 FN48 (μm) | G2 FN42 (μm) | G2 FN48 (μm) | G1 430 (μm) | G2 305 (μm) | G4 Invar (μm) |
|---|---|---|---|---|---|---|---|---|---|---|---|---|---|
| G1 | 15 | Invar | 3 | 12 | 12 | 69 | 12 | 12 | 12 | 12 | 40 | 12 | 12 |
| G2 | -35 | FN42 | 4.5 | 9.5 | 23 | 9.5 | 9.5 | 9.5 | 9 | 20 | 4 | 38 | 9.5 |
| G3b | 20 | FN48 | 10 | 10 | 10 | 10 | 19 | 10 | 10 | 10 | 10 | 10 | 10 |
| G3t | 8 | FN48 | 10 | 10 | 10 | 10 | 10 | 10 | 10 | 10 | 10 | 10 | 10 |
| G4 | -17 | FN42 | 4.5 | 4.5 | 4.5 | 4.5 | 4..5 | 9.5 | 4.5 | 4.5 | 4 | 4 | 1.5 |
| G5b | 8 | 305 | 19 | 16 | 16 | 16 | 106 | 16 | 16 | 16 | 16 | 16 | 16 |
| G5t | 5 | 305 | 19 | 14 | 14 | 14 | 14 | 14 | 14 | 14 | 14 | 14 | 14 |
| G6 | 2 | 305 | 19 | 12 | 12 | 12 | 12 | 12 | 12 | 12 | 12 | 12 | 12 |
| Nominal Frat-X | (μm) | | | 273 | -207 | 1128 | 453 | 188 | 291 | -95 | 894 | -716 | 324 |

Fig. 3

METHOD OF MAKING COLOR PICTURE TUBES HAVING A MIX OF ELECTRON GUNS

The present invention relates to the process of making color picture tubes and, particularly, to a method of fabricating a plurality of color picture tubes of the same size that include a mix of at least two different types of electron guns therein.

BACKGROUND OF THE INVENTION

Most modern color picture tubes have inline electron guns. An inline electron gun is one designed to generate or initiate preferably three electron beams in a common plane and to direct those beams along convergent paths to a point or small area of convergence near the tube screen. Inline electron guns have a beam forming region and a main focus lens and may also include a prefocus lens. The beam forming region usually comprises three cathodes and three consecutive electrodes. A prefocus lens may comprise two or three electrodes. The main focusing lens is usually formed by two spaced electrodes.

Characteristically, the two outer electron beams, usually associated with red- and blue-emitting phosphors in most color picture tube inline electron guns, move horizontally as focus voltage is varied. This focus voltage-related sensitivity characteristic of a tube is commonly referred to in the art as its differential horizontal FRAT or FRAT-X R/B. Typically, FRAT-X R/B is defined as the movement of a beam landing on the screen of the tube, measured in millimeters, for a focus voltage change of 2 kV. The magnitude of FRAT-X RIB depends on dimensions and spacings of electron gun electrodes and is usually non-zero and variable from gun to gun. Variation in FRAT-X R/B magnitude poses several problems. First, to the extent that the focus voltage used in a particular receiver chassis is different from the focus voltage used when a yoke was originally attached to the tube, any magnitude of FRAT-X R/B will cause static convergence errors over the screen area. Secondly, a tube-to-tube difference in FRAT-X R/B is an indication of different inter-beam spacings in the main lenses of the tube electron guns, which creates grouping differences in the tubes. Both are potential problems to a tube maker, who generally seeks a small magnitude and controlled value of FRAT-X R/B.

By design, one can usually achieve an acceptably small value of FRAT-X R/B by using known techniques of aperture offsets and/or thickness variations in the electrodes. However, there are families of electron guns which use many common electrodes, but have slightly different FRAT-X R/B due to non-common electrodes, thus causing grouping differences when used in the same tube. These grouping differences, caused by FRAT-X R/B differences typically less than 1 mm/2 kV, can be corrected in a particular tube by means of known screen and lighthouse adjustments (i.e., commonly known as "Q" and "X" adjustments).

A relatively new problem has emerged, namely, the fabrication of tubes of the same size, but having different electron gun types, where the tube manufacturer cannot adjust the photoscreening lighthouses for each gun type and must live with a compromise situation in terms of grouping errors for all gun types. In such a case, a difference of 1 mm in FRAT-X R/B between tubes may be unacceptable.

SUMMARY OF THE INVENTION

The present invention provides an improvement in a method of making a plurality of color picture tubes of approximately the same size, which tubes include a mix of at least two different types of electron guns therein. The electron guns include each a plurality of electrodes, with each electrode having openings for the passage of three electron beams. The improvement comprises selecting materials for each electrode of at least two different types of electron guns that will produce the minimum difference in the focus voltage sensitivities between the two different types of electron guns.

BRIEF DESCRIPTION OF THE DRAWINGS

FIG. 3 presents two tables illustrating the effect of changing materials of various electrodes of two different type electron guns in two color picture tubes.

DETAILED DESCRIPTION OF THE PREFERRED EMBODIMENTS

Figure 1:
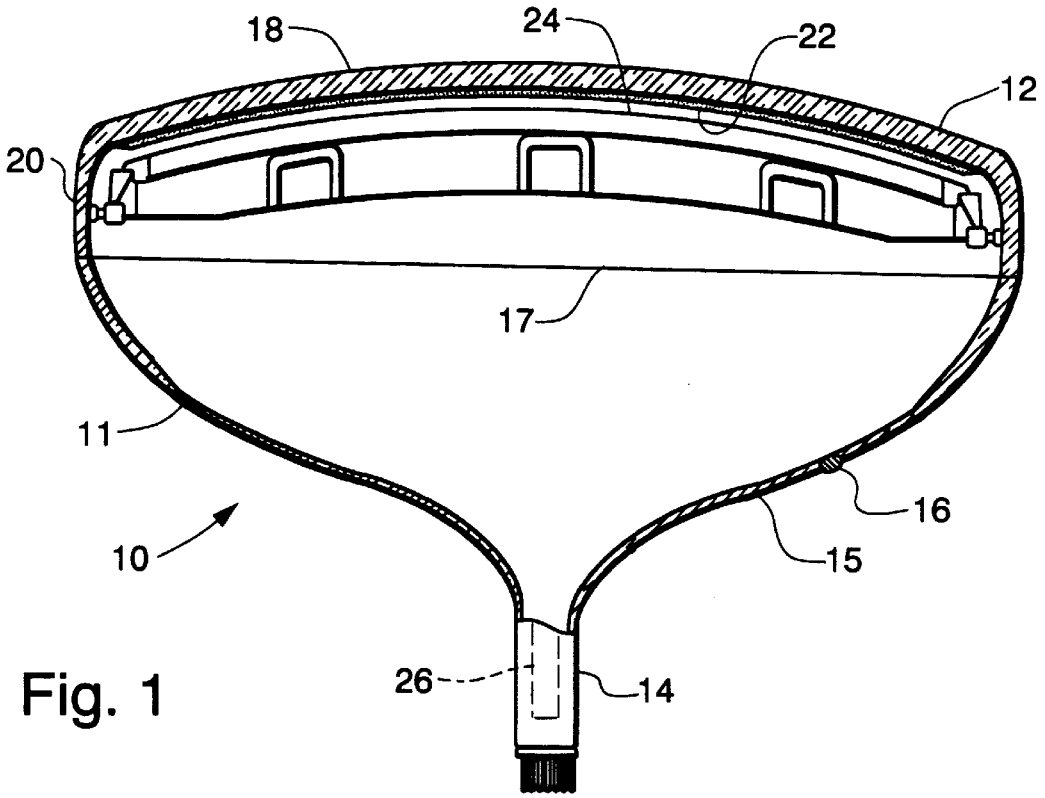
FIG. 1 is a side view, partly in axial section, of a color picture tube.

FIG. 1 shows a rectangular color picture tube 10 having a glass bulb or envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a transparent rectangular viewing faceplate 18, and a peripheral flange or sidewall 20 which includes a seal land that is sealed to the funnel 15 by a glass frit 17. A three-color phosphor screen 22 is carried by the inner surface of the faceplate 18. The screen 22, preferably, is a line screen with the phosphor lines arranged in triads, each triad including a phosphor line of each of the three colors. Alternatively, the screen can be a dot screen, and it may or may not include a light-absorbing matrix. A multi-apertured color selection electrode or shadow mask 24 is removably mounted in predetermined spaced relation to the screen 22. An electron gun 26, shown schematically by dashed lines in FIG. 1, is centrally mounted within the neck 14 to generate and direct three electron beams along convergent paths through the mask 24 to the screen 22.

Figure 2:
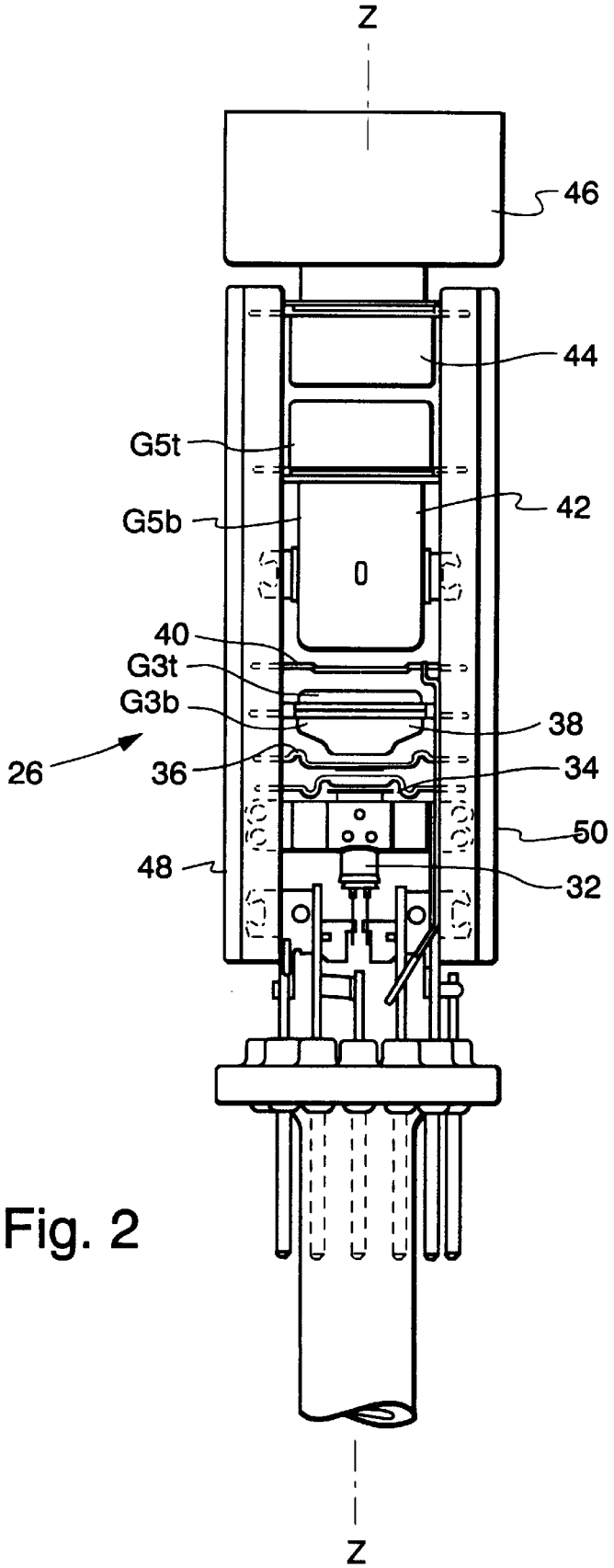
FIG. 2 is a plan view of the electron gun of the tube of FIG. 1.

The details of the electron gun 26 are shown in FIG. 2. The gun 26 comprises three spaced inline cathodes 32 (K) (one for each beam, only one being shown), a control grid electrode 34 (G1), a screen grid electrode 36 (G2), an accelerating electrode 38 (G3), prefocus lens electrode 40 (G4), first main focusing lens electrode 42 (G5), and a second main focusing lens electrode 44 (G6), spaced in the order named. Each of the G1 through G6 electrodes has three inline apertures located at ends therein, to permit passage of three electron beams therethrough. The electrostatic main focusing lens in the gun 26 is formed by the facing portions of the G5 electrode 42 and the G6 electrode 44. All of the electrodes of the gun 26 are either directly or indirectly connected through tabs or claws to two insulative support rods 48 and 50, which are usually of glass and commonly referred to as beads.

The G1 and G2 electrodes, 34 and 36, respectively, are apertured flat plates, which may or may not include reinforcing ribs therein. The G3 electrode 38 is formed by two shallow cup-shaped elements, G3b and G3t, the open ends of which are attached to each other. The G4 electrode 40 is an apertured flat plate. The G5 electrode 42 is formed by two deep-drawn cup-shaped elements, G5b and G5t, the open ends of which are attached to each other. The G6 electrode 44 is cup-shaped, with its open end connected to a shield cup 46.

As previously indicated, the sensitivity of electron beam movement to focus voltage change, or FRAT-X R/B, in an electron gun is determined both by the design and the interaperture R/B (red-to-blue) spacings of each of the electrodes. Because the FRAT-X R/B of concern to the present invention occurs when an electron gun and tube have reached stabilized temperatures, electrode materials are selected so as to use the different thermal expansions of the materials to adjust inter-aperture spacing, to offset the initial differences in FRAT-X R/B caused by the design of the gun.

FIG. 3 presents two tables for two different tubes, designated Tube A and Tube B. These two tubes are identical in all respects, except that they include different types of electron guns. The electrodes for each of these guns are identified in the first column of each chart as G1–G6. The second column lists the FRAT-X R/B to inter-aperture spacing sensitivity coefficient, or simply FRAT-X R/B sensitivity coefficient, for each electrode. This sensitivity coefficient is defined as the change in FRAT-X R/B of an electron gun (i.e., microns of FRAT-X R/B per 2 kV) to changes in the inter-aperture spacings between outer apertures of the electrodes (i.e., microns of R/B inter-aperture spacing). The third column identifies the material forming each electrode of an original, unaltered, electron gun. The fourth column lists the coefficient of thermal expansion for each of the materials in the second column, within the temperature range to which each electrode will be subjected. The fifth column presents the outer aperture-to-outer aperture expansion of each electrode at its stabilized temperature, measured in microns. The sixth through the thirteenth columns present the outer aperture-to-outer aperture expansion of each electrode at its stabilized temperature, measured in microns, when changes are made in the materials for individual electrodes. For example, in the seventh column for both tubes, 305 stainless steel is substituted for 430 stainless steel in the G1 electrode of Tube A and for Invar in the G1 electrode of Tube B. These substitutions result in changes in expansion of the G1 electrode from 40 microns to 69 microns in Tube A and changes in expansion of the G1 electrode from 12 microns to 69 microns in Tube B. Across the bottom of each chart are the resulting measurements or calculations for FRAT-X R/B of electron guns with the materials designated in the fifth through twelfth columns.

In accordance with the present invention, the FRAT-X R/B or focus voltage sensitivities of the two tubes, for various combinations of electrode materials are compared; and the closest sensitivities for the two tubes are selected. In the example of Tube A and Tube B in FIG. 3, the closest match is the −700 micron magnitude for FRAT-X R/B of Tube A, with the standard original material electrodes, and the −716 micron magnitude for FRAT-X R/B of Tube B, with the G2 material substitution of 305 steel for the FN42 steel of the standard or original electron gun. By using such a technique, it is possible to select materials for each electrode of at least two different types of electron guns, to produce a minimum difference in FRAT-X R/B between the two tubes.

With the present invention, the individual electron gun types of tubes having a mix of gun types therein can be "fine tuned", by the appropriate choice of electrode materials, to adjust the FRAT-X R/B averages for the different electron guns towards a common value. By changing the grid materials, rather than the design of the electron guns, no changes need to be made in gun assembly techniques and in the required fabrication fixtures. This simplification is a great advantage to tube manufacturers.

What is claimed is:

1. In a method of making a plurality of color picture tubes of similar size and including a mix of at least two different types of electron guns therein, said electron guns including each a plurality of electrodes, each electrode having openings for the passage of three electron beams, the improvement comprising selecting materials for each electrode of said at least two different types of electron guns that will produce a minimum difference in the focus voltage sensitivities between the two different types of electron guns.

2. In a method of making a plurality of color picture tubes of similar size and including a mix of at least two different types of inline electron guns therein, said electron guns including each a plurality of electrodes, each electrode having openings for the passage of three electron beams, the improvement comprising determining a FRAT-X R/B sensitivity coefficient for each electrode of said at least two electron guns, determining the outer aperture-to-outer aperture expansion of said each electrode of said at least two electron guns, at the stabilized operating temperature of said each electrode, determining the outer aperture-to-outer aperture expansions of at least some of the electrodes of at least one of said at least two electron guns, when different materials are substituted for the original materials in said at least some electrodes, determining FRAT-X R/B for each tube, by summing the products of the FRAT-X R/B sensitivity coefficient and the outer aperture-to-outer aperture expansion of said each electrode in each electron gun, and selecting the electrode materials of the electron guns that produce the closest FRAT-X R/B determinations for at least two tubes.

3. In a method of making a plurality of color picture tubes of the similar size and including a mix of at least two different types of electron guns therein, the improvement comprising determining the FRAT-X R/B sensitivities of at least some of the electrodes of at least one type of said electron guns, determining the focus voltage related sensitivities of at least two tubes of said plurality having different types of electron guns therein by using the determined FRAT-X R/B sensitivities, repeating the determination of focus voltage related sensitivities for said at least two tubes of said plurality having different types of electron guns therein with different materials substituted for the electrodes in the electron guns, and selecting the tubes with different types of electron guns that have the closest focus voltage related sensitivities.

4. In a method of making a plurality of color picture tubes of the similar size and including a mix of at least two different types of electron guns therein, said electron guns including each a plurality of electrodes, each electrode having openings for the passage of three electron beams, the improvement comprising determining the coefficients of thermal expansion for different materials including the materials of each electrode of electron guns in at least two tubes, determining a FRAT-X R/B sensitivity coefficient for each electrode of said at least two electron guns, determining the stabilized operating temperature of said each electrode of said electron guns in at least two tubes, determining the outer aperture-to-outer aperture expansion of said each electrode of said at least two electron guns, at the stabilized operating temperature of said each electrode, determining the outer aperture-to-outer aperture expansions of at least some of the electrodes of at least one of said at least two electron guns, when different materials are substituted for the original materials in said at least some electrodes, determining FRAT-X R/B for each tube by summing the products of the FRAT-X R/B sensitivity coefficient and the outer aperture-to-outer aperture expansion of said each electrode in each electron gun, and selecting the electrode materials of the electron guns that produce the closest FRAT-X R/B determinations for at least two tubes.

* * * * *